US007540585B2

(12) United States Patent
Chou et al.

(10) Patent No.: US 7,540,585 B2
(45) Date of Patent: Jun. 2, 2009

(54) DEVICE AND METHOD FOR RESIDUE REMOVAL

(75) Inventors: Po-Fu Chou, Taoyuan County (TW); Chun-Jung Chen, Yunlin (TW); Ching-Chiu Liao, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/736,558

(22) Filed: Apr. 17, 2007

(65) Prior Publication Data

US 2008/0149143 A1 Jun. 26, 2008

(30) Foreign Application Priority Data

Dec. 25, 2006 (TW) ..... 95148764 A

(51) Int. Cl.
*B41J 2/165* (2006.01)

(52) U.S. Cl. ..... 347/33; 347/28; 347/29; 347/32

(58) Field of Classification Search ..... 347/22, 347/100, 24–35
See application file for complete search history.

(56) References Cited

U.S. PATENT DOCUMENTS

| | | | | |
|---|---|---|---|---|
| 5,574,485 | A * | 11/1996 | Anderson et al. | 347/27 |
| 5,644,345 | A | 7/1997 | Toniolo | |
| 5,905,514 | A | 5/1999 | Rhoads et al. | |
| 5,969,731 | A | 10/1999 | Michael et al. | |
| 6,196,656 | B1 | 3/2001 | Ghosh et al. | |
| 6,280,014 | B1 | 8/2001 | Sharma et al. | |
| 6,347,858 | B1 | 2/2002 | Faisst, Jr. et al. | |
| 6,679,601 | B1 | 1/2004 | Pham et al. | |
| 6,692,100 | B2 | 2/2004 | Steinfield et al. | |
| 6,869,161 | B2 | 3/2005 | Wouters et al. | |

* cited by examiner

*Primary Examiner*—Shih-Wen Hsieh
(74) *Attorney, Agent, or Firm*—Quintero Law Office

(57) ABSTRACT

A residue removal device includes an object, a sink, and a conveying device. The object includes a contact surface. Residue exists on the contact surface. A solution is contained in the sink. The sink is disposed below the contact surface. The solution corresponds to the contact surface. The conveying device drives the relative motion between the object and the sink. When the residues on the contact surface are contacted by the solution and relative motion is generated between the residues of the contact surface and the solution, the residues are removed by the solution.

32 Claims, 6 Drawing Sheets

| Cartridge No. | Cleaning before or after | Average of directional error | Average diameter of liquid drops | The number of nozzles with excess liquid drops | The number of nozzles with insufficient liquid drops | The number of qualified nozzles |
|---|---|---|---|---|---|---|
| A | before | 11.54 | 77.49 | 2 | 30 | 125 |
| A | after | 8.48 | 85.18 | 2 | 9 | 176 |
| B | before | 7.64 | 81.49 | 34 | 10 | 155 |
| B | after | 7.54 | 87.37 | 6 | 7 | 183 |
| C | before | 5.53 | 79.58 | 35 | 7 | 162 |
| C | after | 5.41 | 83.87 | 3 | 5 | 193 |
| D | before | 8.66 | 74.64 | 20 | 66 | 123 |
| D | after | 7.54 | 80.23 | 0 | 0 | 174 |

FIG. 4

DEVICE AND METHOD FOR RESIDUE REMOVAL

BACKGROUND OF THE INVENTION

1. Field of the Invention

The invention relates to a device and a method for removing residue, and more particularly, to a device and a method for effectively removing residue from contact surfaces and enhancing dispensing quality.

2. Description of the Related Art

Inkjet systems have been researched and developed for decades, and improvement of inkjet quality has been topics of research and development. One factor influencing inkjet quality is the cleaning of nozzle plates. The four major cleaning methods are using a scraper or wiping the inkjet head directly, utilizing a control circuit to continuously dispense liquid to clean the front of the nozzle plates, vacuum ink pumping and high-frequency oscillation.

Inkjet systems have been used extensively in different industrial applications, such as LCD fabrication, biomedical science, and material science. The four types of cleaning methods, however, are not suitable for cleaning nozzle plates in all field of application. In biomedical field, for example, using a scraper contaminates biomedical materials; continuous dispensing and vacuum ink pumping waste expensive biomedical materials. Thus, methods for cleaning nozzle plates of all inkjet systems regardless of application are desirable.

BRIEF SUMMARY OF THE INVENTION

The invention provides a residue removal device and a method by utilizing cohesion of the solution for removing residue to maintain nozzle plate cleanliness in inkjet systems.

Accordingly, a residue removal device is provided. The residue removal device comprises an object, a sink, and a conveying device. The object comprises a contact surface. There are residues on the contact surface. The solution is contained in the sink corresponding to of the contact surface. The conveying device drives the relative motion between the object and the sink to remove residue from the contact surface by the solution.

Furthermore, a residue removal method is provided. The residue removal method comprises the following steps. Firstly, a solution, a sink, an object, and a conveying device are provided. The object comprises a contact surface, and there are residues on the contact surface. The solution is contained in the sink. The position of the sink is adjusted so that the solution is in contact with the contact surface. The conveying device drives the relative motion between the sink and the contact surface utilizing the cohesion of the solution to remove residue.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 4 is a table of the experimental result of the residue removal device;

DETAILED DESCRIPTION OF THE INVENTION

The following description is made for the purpose of illustrating the general principles of the invention and should not be taken in a limiting sense. The scope of the invention is best determined by reference to the appended claims.

Figure 1:
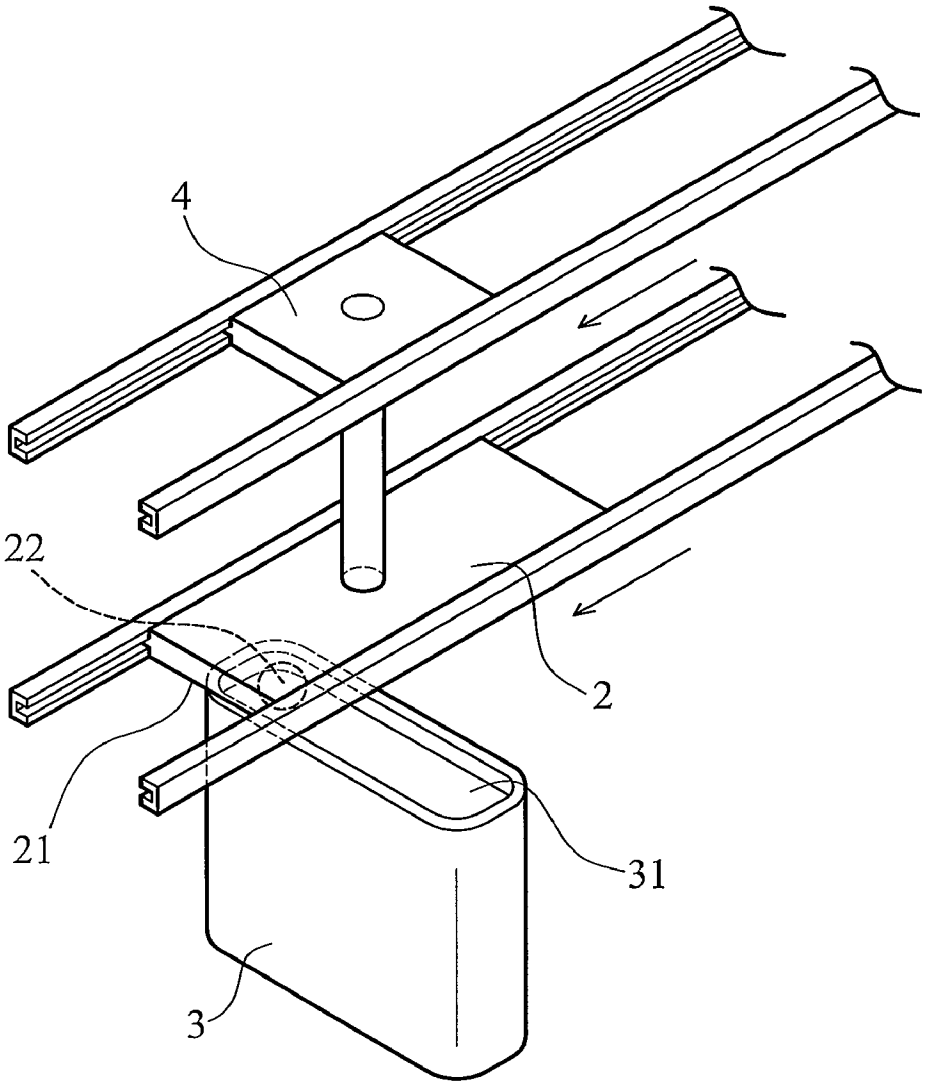
FIG. 1 is a schematic view of an embodiment of a residue removal device.

Referring to FIG. 1, an embodiment of a residue removal device 1 comprises an object 2, a sink 3, and a conveying device 4. The object 2 comprises a contact surface 21. Residues 22 exist on the contact surface 21. Note that only one residue is shown in FIG. 1. The sink 3 is disposed below the contact surface 21, for receiving a solution 31. The solution 31 faces the contact surface 21. The conveying device 4 drives the object 2 or the sink 3 for generating the relative motion therebetween. When the residues 22 on contact surface 21 are in contact with the solution 31 and relative motion between the contact surface 21 and the solution 31 is generated, the residues 22 are removed by the solution 31.

Figure 2:
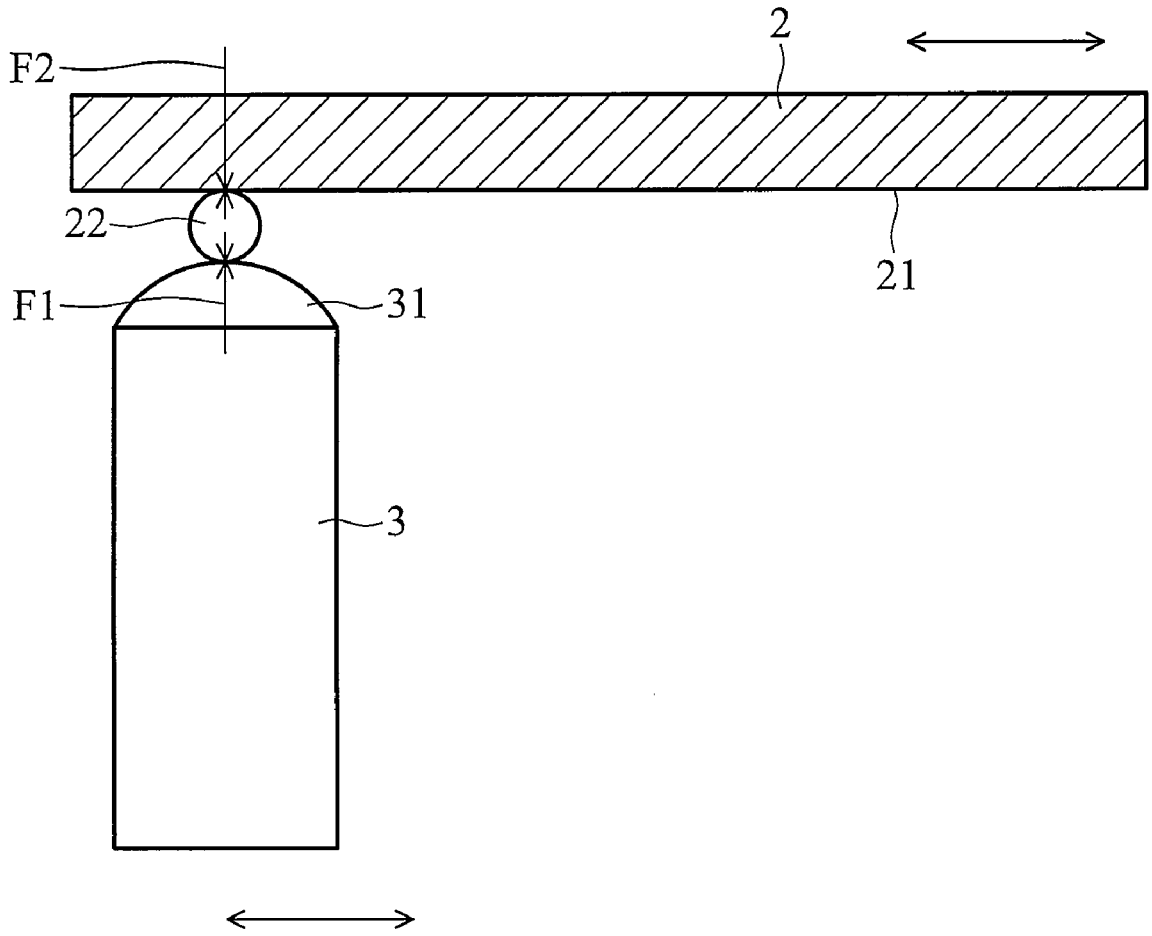
FIG. 2 is a simple lateral schematic view of the residue removal device in FIG. 1.

FIG. 2 is a simple lateral schematic view of the residue removal device of FIG. 1. In FIG. 2, the solution 31 and the residue 22 are shown as liquid drops for clear illustration. A cohesive force F1 is generated between the solution 31 and the residue 22. An adhesive force F2 exists between the residue 22 of the object 2 and the object 2. The residue 22 is adhered to the object 2 by adhesive force F2. When the cohesive force F1 between the solution 31 and the residue 22 is greater than the adhesive force F2 between the object 2 and the residue 22, the residue 22 is separated from the object 2 and adheres to the solution 31. Further, the relative motion between the object 2 and the solution 31 removes the residue 22 from the object 2. The object 2 can be a nozzle plate of the dispensing cartridge in an inkjet system, and the solution 31 contacts with the objects 2 with a larger contact angle. Thus, after cleaning the residue 22 of the nozzle plate 2, the solution 31 is also removed from the nozzle plate 2. The solution 31 can be the same as a dispensing liquid of the inkjet system to prevent secondary pollution, or the solution 31 can be dissolved with the dispensing liquid of the inkjet system.

Figure 3:
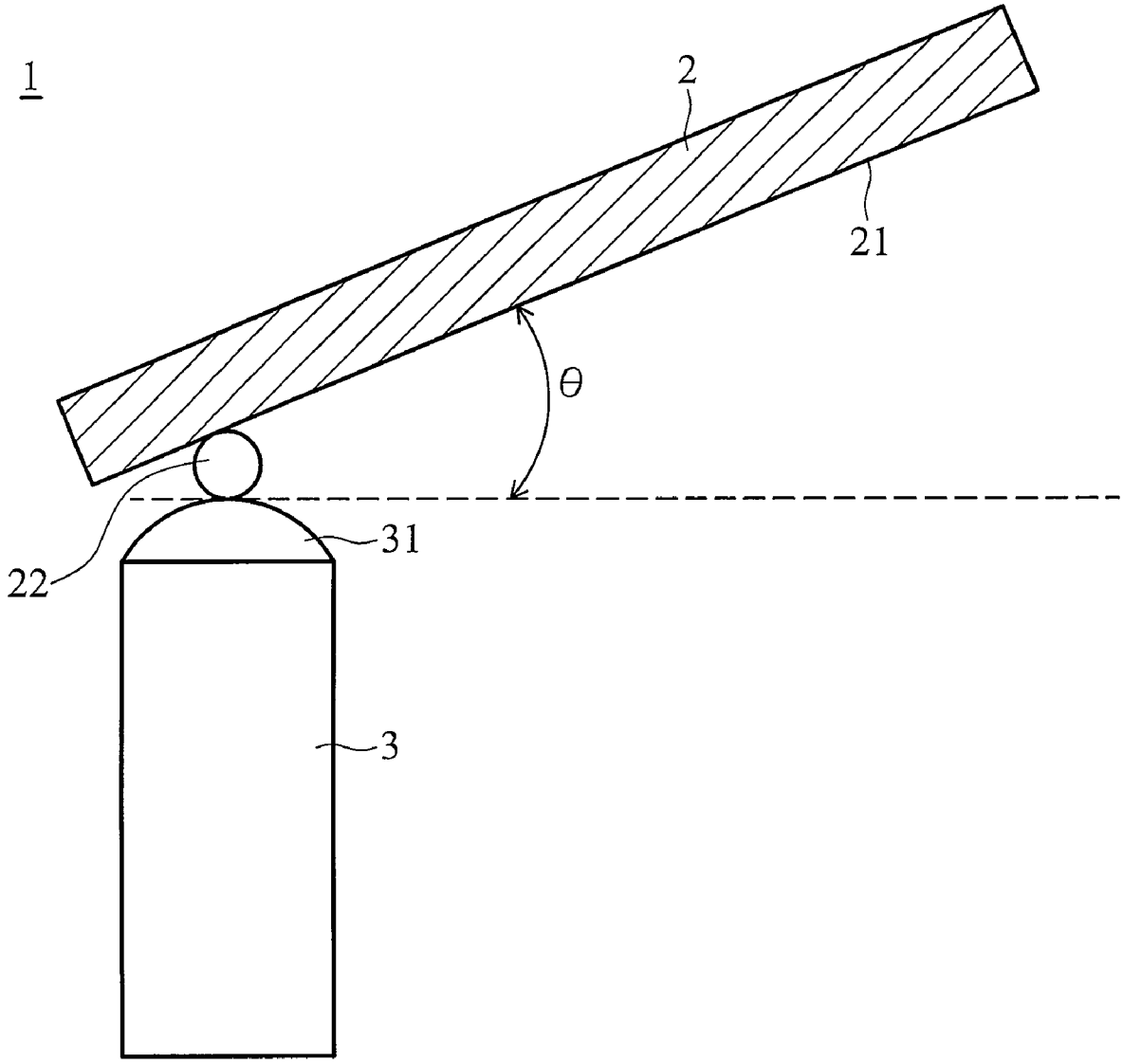
FIG. 3 is another simple lateral schematic view of the residue removal device in disposed differently than the residue removal device of FIG. 2.

FIG. 3 is another simple lateral schematic of the residue removal device in disposed differently than the residue removal device of FIG. 2. In FIG. 3, an inclined angle exists between the object 2 and the sink 3, thus, the tangent line of the surface of the solution 31 and the object 2 comprise an include angle θ. Increasing the included angle θ, raises the cohesion between the liquid drop of the solution 31 and the residue 22 facilitating residue removal, wherein the included angle θ ranges from 15 to 90 degrees. Preferably, the included angle is greater than 50 degrees.

The experimental results of applying the residue removal device are shown in the table of FIG. 4, wherein the solution 31 is a 20% glycerin solution for cleaning each nozzle plate. The qualified numbers of nozzles (the number of nozzles on the nozzle plates) before and after cleaning of four dispensing cartridges A, B, C, and D are shown in the table of FIG. 4. The increase in the number of qualified nozzles is perceptible when the residue removal device 1 is applied.

Figure 5:
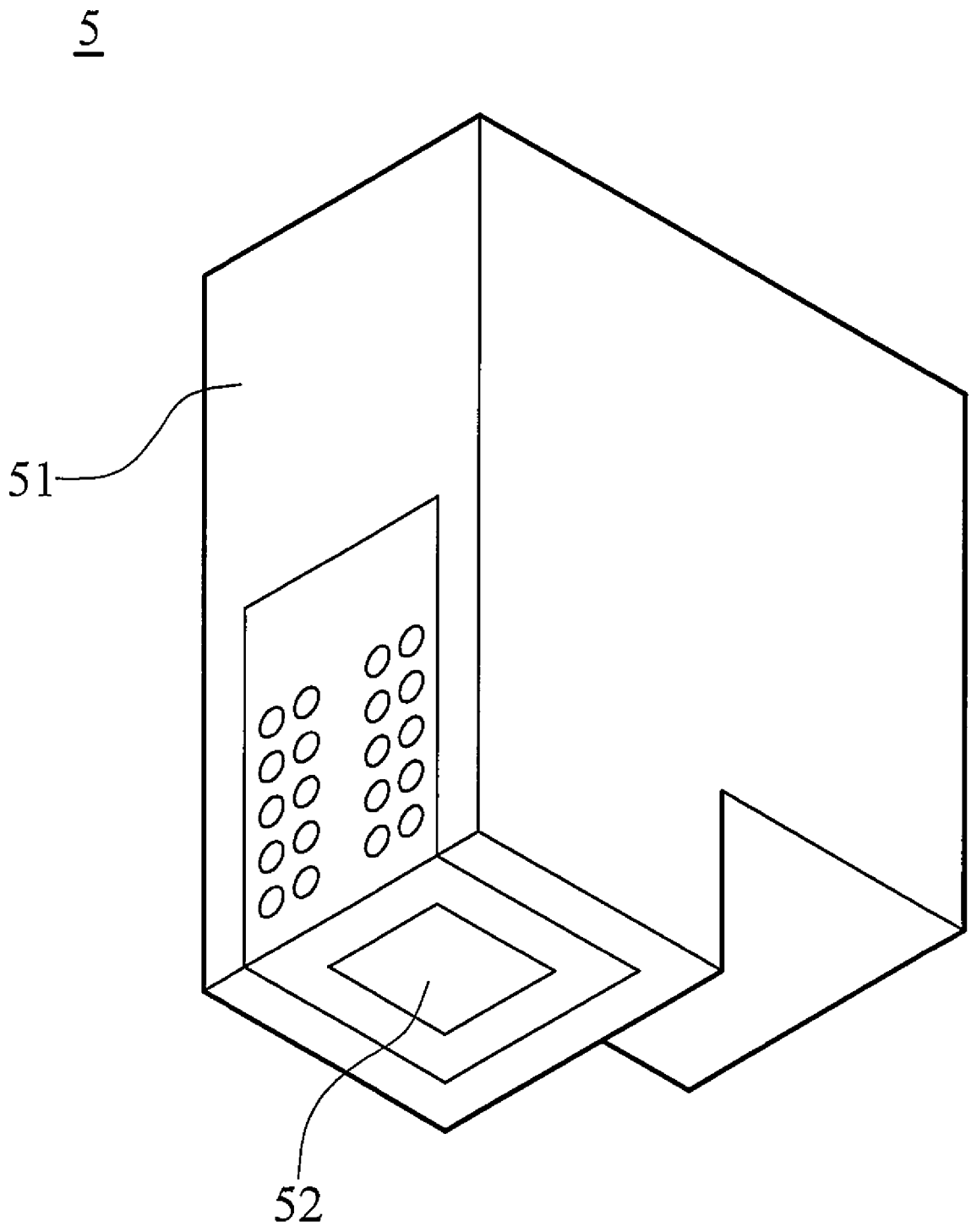
FIG. 5 is a schematic view of the residue removal device applied to an inkjet system.
Figure 6:
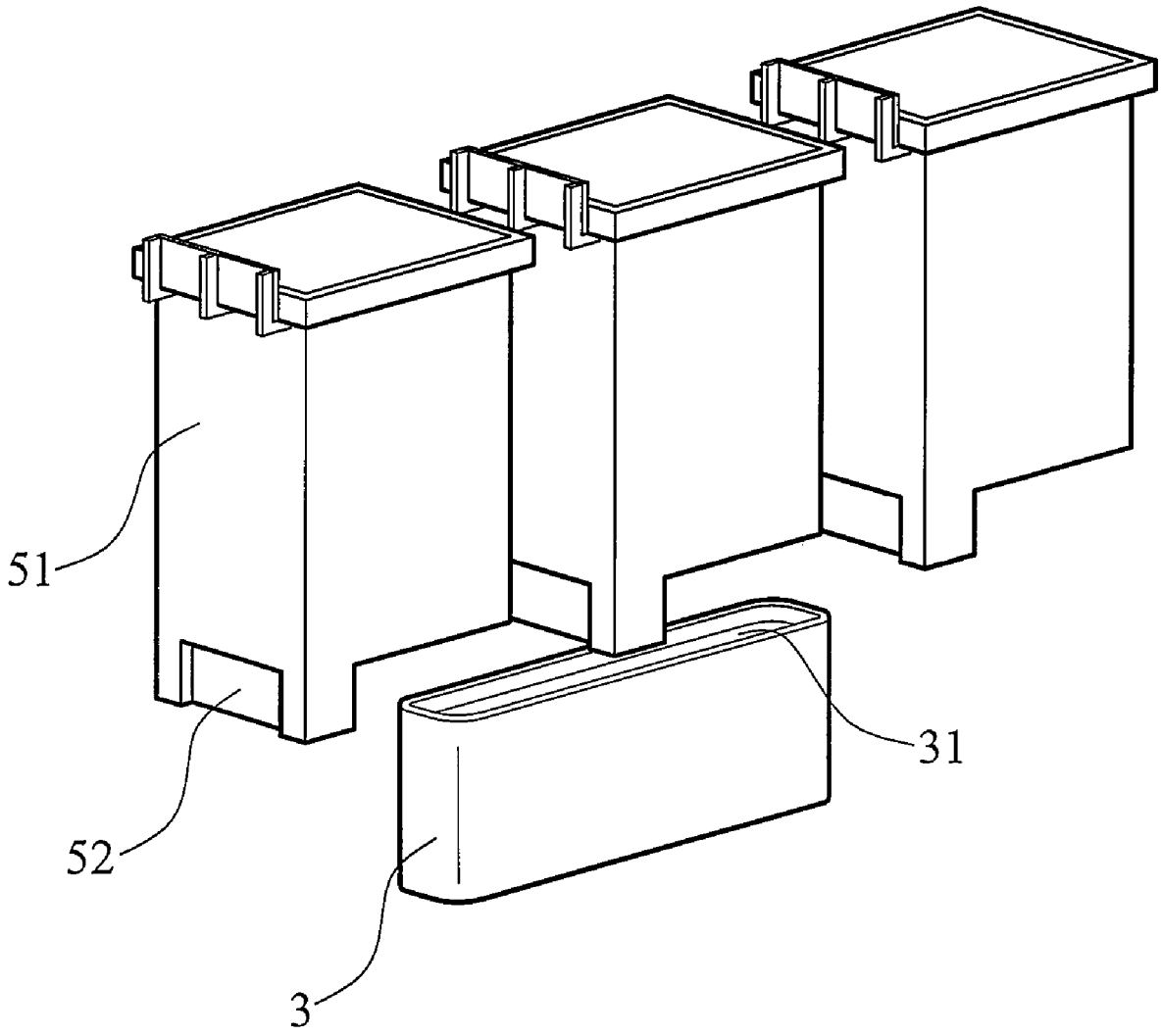
FIG. 6 is a schematic view of an applied embodiment of the residue removal device.

The residue removal device 1 can also be applied to inkjet platforms, as shown in FIG. 5. The inkjet system 5 comprises at least a dispensing cartridge 51 and a nozzle plate 52. Thus, a plurality of dispensing cartridges 51 can be arranged as shown in FIG. 6, and the sink 3 and the solution 31 of the residue removal device 1 removes the residue on each nozzle plate. The residue removal device 1, can be used when the inkjet system is idle or operational, to prevent liquid from remaining on the nozzle plate 52, thus, the quality of dispensing maintained. The residue removal device also can be used with nanotechnology in biomedical manufacturing systems.

Note that the conveying device 4 can be disposed on the object 2 as shown in FIG. 1, or can be disposed on the sink 3. As shown by the arrow of FIG. 2, the sink 3 can be moved leftward and rightward. The conveying device 4 can also be disposed both on the object 2 and the sink 3, producing relative motion for removing the residue 22. The conveying device may be a moving platform.

A residue removal method of the residue removal device 1 is provided. The solution 31 is disposed in the sink 3. The sink 3 is then adjusted so that the solution 31 contacts the contact surface 21. The solution 31 simultaneously contacts the residues 22 of the object 2, as shown in FIG. 2 and FIG. 3. Relative motion is then generated by conveying device 4, and the cohesive force of the solution 31 in the sink 3 becomes greater than the adhesive force of the contact surface 21. Thus, the residues 22 are removed from the contact surface 21 by the solution 31.

The residue removal device provides a method for cleaning nozzles of an inkjet system by removing residue. Removing residue raises dispensing quality, prevents pollutant accumulation and reduces material consumption.

While the invention has been described by way of example and in terms of the preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A residue removal device comprising:

an object comprising a contact surface, wherein residue exists on the contact surface;

a sink containing a solution, wherein the solution faces the contact surface; and a conveying device generating relative motion between the object and the sink, wherein the object is disposed on the conveying device and the conveying device moves the object, so that residue is removed from the contact surface by the solution.

2. The residue removal device as claimed in claim 1, wherein when the residue on the contact surface is in contact with the solution and relative motion between the contact surface and the solution is generated, the residue is removed by the solution.

3. The residue removal device as claimed in claim 1, wherein the solution comprises a surface having a convex portion, and an angle is formed between the contact surface and a tangent line of the surface of the solution at an apex of the convex portion.

4. The residue removal device as claimed in claim 3, wherein when the angle becomes greater, the cohesion between the solution and the residue is increased.

5. The residue removal device as claimed in claim 3, wherein the angle ranges between 15 to 90 degrees.

6. The residue removal device as claimed in claim 3, wherein the angle is greater than 50 degrees.

7. The residue removal device as claimed in claim 1, wherein a contact angle between the contact surface and the solution is greater than a contact angle between the contact surface and the residue.

8. The residue removal device as claimed in claim 1, wherein the object is an inkjet system.

9. The residue removal device as claimed in claim 8, wherein the inkjet system comprises a nozzle plate.

10. The residue removal device as claimed in claim 8, wherein the solution is the same as a dispensing liquid of the inkjet system.

11. The residue removal device as claimed in claim 8, wherein the solution and a dispensing liquid of the inkjet system are dissolved.

12. The residue removal device as claimed in claim 8, wherein the solution is a solvent for a dispensing liquid of the inkjet system.

13. The residue removal device as claimed in claim 1, wherein the solution is a glycerin solution.

14. The residue removal device as claimed in claim 1, wherein the conveying device is a moving platform.

15. A residue removal device comprising:

an object comprising a contact surface, wherein a residue exists on the contact surface;

a sink containing a solution, wherein the solution has a convex surface facing the contact surface, and the convex surface is in contact with the residue; and a conveying device generating relative motion between the object and the sink so as to remove the residue from the contact surface.

16. The residue removal device as claimed in claim 15, wherein the residue is a liquid droplet.

17. The residue removal device as claimed in claim 16, wherein the object is an inkjet system and the contact surface is a nozzle plate thereof.

18. The residue removal device as claimed in claim 15, wherein the convex surface of the solution protrudes from the sink.

19. A residue removal device comprising:

an object comprising a contact surface, wherein residue exists on the contact surface;

a sink containing a solution, wherein the solution faces the contact surface; and a conveying device generating relative motion between the object and the sink, so that residue is removed from the contact surface by the solution;

wherein the solution comprises a surface having a convex portion, and an angle is formed between the contact surface and a tangent line of the surface of the solution at an apex of the convex portion.

20. The residue removal device as claimed in claim 19, wherein when the angle becomes greater, the cohesion between the solution and the residue is increased.

21. The residue removal device as claimed in claim 19, wherein the angle ranges between 15 to 90 degrees.

22. The residue removal device as claimed in claim 19, wherein the angle is greater than 50 degrees.

23. The residue removal device as claimed in claim 19, wherein when the residue on the contact surface is in contact with the solution and relative motion between the contact surface and the solution is generated, the residue is removed by the solution.

24. The residue removal device as claimed in claim 19, wherein the sink is disposed on the conveying device, and the conveying device moves the sink.

25. The residue removal device as claimed in claim 19, wherein a contact angle between the contact surface and the solution is greater than a contact angle between the contact surface and the residue.

26. The residue removal device as claimed in claim 19, wherein the object is an inkjet system.

27. The residue removal device as claimed in claim 26, wherein the inkjet system comprises a nozzle plate.

28. The residue removal device as claimed in claim 26, wherein the solution is the same as a dispensing liquid of the inkjet system.

29. The residue removal device as claimed in claim 26, wherein the solution and a dispensing liquid of the inkjet system are dissolved.

30. The residue removal device as claimed in claim 26, wherein the solution is a solvent for a dispensing liquid of the inkjet system.

31. The residue removal device as claimed in claim 19, wherein the solution is a glycerin solution.

32. The residue removal device as claimed in claim 19, wherein the conveying device is a moving platform.

* * * * *